252-95 AU 166 EX
1/20/81 XR 4,246,129

United States Patent [19]
Kacher

[11] 4,246,129
[45] Jan. 20, 1981

[54] SURFACTANT CAKE COMPOSITIONS CONTAINING SOLUBILITY REDUCING AGENTS

[75] Inventor: Mark L. Kacher, Cincinnati, Ohio

[73] Assignee: The Procter & Gamble Company, Cincinnati, Ohio

[21] Appl. No.: 30,976

[22] Filed: Apr. 18, 1979

[51] Int. Cl.[3] ..... C11D 7/26; C11D 7/54; C11D 17/04

[52] U.S. Cl. ..... 252/90; 252/95; 252/174; 252/550; 252/554; 252/558; 252/DIG. 16

[58] Field of Search ..... 252/174, 550, 551, 554, 252/558, DIG. 16; 4/222-224; 222/148

[56] References Cited

U.S. PATENT DOCUMENTS

| | | | |
|---|---|---|---|
| 1,020,624 | 3/1912 | Rülke | 252/107 |
| 2,643,229 | 6/1953 | Walters | 252/174 X |
| 3,030,310 | 4/1962 | Turck | 252/121 |
| 3,070,547 | 12/1962 | Chaffee | 252/121 |
| 3,312,627 | 4/1967 | Hooker | 252/548 |
| 3,647,847 | 3/1972 | Curtis et al. | 260/489 |
| 3,856,932 | 12/1974 | May | 424/16 |
| 3,928,247 | 12/1975 | Mookherjee et al. | 252/522 |
| 3,929,676 | 12/1975 | Chappell et al. | 252/522 |
| 4,012,341 | 3/1977 | Orshitzer et al. | 252/548 |
| 4,043,931 | 8/1977 | Jeffrey et al. | 252/93 |
| 4,119,578 | 10/1978 | Daeninckx | 252/548 |
| 4,139,484 | 2/1979 | Sanders et al. | 252/174.11 |

FOREIGN PATENT DOCUMENTS

| | | | |
|---|---|---|---|
| 1364460 | 8/1974 | United Kingdom | 252/106 |
| 1465475 | 2/1977 | United Kingdom | 252/106 |
| 582270 | 6/1977 | U.S.S.R. . | |

*Primary Examiner*—P. E. Willis, Jr.
*Attorney, Agent, or Firm*—Ronald L. Hemingway; Richard C. Witte

[57] ABSTRACT

Solid surfactant cake compositions are disclosed which incorporate certain solubility reducing materials. The surfactant is an anionic surfactant selected from the organic sulfates and sulfonates. The solubility reducing agent is preferably selected from the group consisting of:

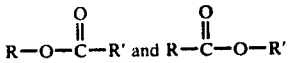

wherein R' is methyl or ethyl and R is selected from: (1) [m.n.o]bicycloalkane derivatives having the following skeletal structure:

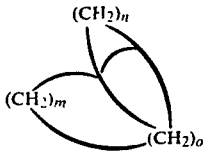

wherein m is from 2 to 3, n is from 1 to 2 and o is from 1 to 2, and wherein a nonbridgehead site of said R moiety is attached to the balance of the molecule; (2) a derivative of [4.4.0]trans-decalin having the following skeletal structure:

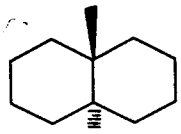

wherein a nonbridgehead site of said R moiety is attached to the balance of the molecule; (3) a derivative of cyclohexane having the following skeletal structure.

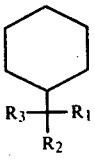

wherein $R_1$, $R_2$ and $R_3$ are each selected from an ethyl, methyl or propyl moiety, and wherein the balance of the molecule is attached to the 2, 3, 4, 5 or 6 position of the cyclohexane ring of said R moiety; or (4) a n-nonyl moiety. The solubility reducing agent may also be a compound having the the following structure:

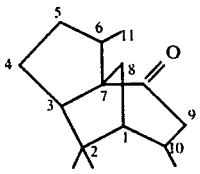

The composition has utility as a solid surfactant cake which may be placed in a toilet tank dispenser to distribute a surfactant and other ingredients to a toilet bowl when the toilet is flushed.

24 Claims, No Drawings

SURFACTANT CAKE COMPOSITIONS CONTAINING SOLUBILITY REDUCING AGENTS

TECHNICAL FIELD

The present invention relates in general to a solid tableted surfactant composition of limited solubility which is useful for a variety of purposes. More specifically, the invention relates to such solid cake compositions which are adapted for use in conjunction with a toilet tank dispenser to dispense a ration of surfactants and other ingredients to the bowl of a toilet, responsive to the flushing thereof.

BACKGROUND ART

Surfactant cakes which contain components to reduce their solubility for various purposes are disclosed in the prior art. See, for example, U.S. Pat. Nos. 4,119,578 (Daeninckx et al.); 4,012,341 (Orshitzer et al.); and 2,643,229 (Walters).

Certain of the solubility reducing agents disclosed herein are known in the prior art, but are disclosed as perfume components, rather than for the purposes set forth herein. For example, U.S. Pat. No. 3,928,247 (Mookherjee) and U.S. Pat. No. 3,647,847 (Curtis et al.) disclose the combination of isobornyl acetate and a surfactant. However, these references do not anticipate that such compounds may be used, in the proportions set forth hereinafter, to reduce the solubility of certain anionic surfactants as disclosed herein.

Finally, the prior art discloses unrelated uses for the solubility reducing compounds of the present invention. For example, see U.S. Pat. No. 1,020,624 (Rülke) and Soviet Union Disclosure No. 582,270, published June 12, 1977 (Asanova).

SUMMARY OF THE INVENTION

The invention is a solid, water dispersible surfactant cake comprising certain anionic surfactants and certain solubility reducing agents. The cake can additionally comprise certain optional ingredients.

The anionic surfactants which are useful herein are selected from the organic sulfates and sulfonates. Preferred anionic surfactants are alkali metal paraffin sulfonates, the alkali metal salts of linear alkyl benzene sulfonates, and certain branched alkali metal alkyl sulfates. Most preferred are sodium paraffin sulfonate surfactants. The surfactant comprises 40% to 99.5% of the composition. (Composition percentages are by weight unless otherwise specified.)

The solubility reducing agent comprises 0.5% to 20%, preferably 2% to 11%, and most preferably 3% to 7% of the overall composition. The solubility reducing agent can be broadly described as an organic compound which reduces the solubility of the anionic surfactant by at least 5% at room temperature (about 20° C.), and preferably by at least 25%, as determined by the MIPS test set forth hereinafter in this specification. The solubility reducing agent is preferably selected from a group consisting of:

$$R-O-\overset{\overset{\large O}{\|}}{C}-R' \text{ and } R-\overset{\overset{\large O}{\|}}{C}-O-R'$$

wherein R′ is methyl or ethyl and R is selected from: (1) an [m.n.o]bicycloalkane derivative having the following skeletal structure:

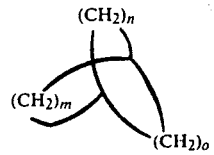

wherein m is from 2 to 3, n is from 1 to 2, and o is from 1 to 2, and wherein a nonbridgehead site of said R moiety is attached to the balance of the molecule; (2) a derivative of [4.4.0]trans-decalin having the following skeletal structure:

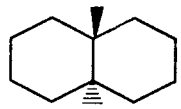

wherein a nonbridgehead site of said R moiety is attached to the balance of the molecule; (3) a derivative of cyclohexane having the following skeletal structure:

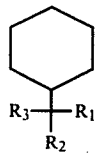

wherein $R_1$, $R_2$ and $R_3$ are independently selected from an ethyl, methyl or propyl moiety, and wherein the balance of the molecule is attached to the 2, 3, 4, 5 or 6 position (hereinafter sometimes referred to collectively as the "non-1" position) of the cyclohexane ring of said R moiety; and (4) a nonyl moiety. An additional material which may be used to reduce the solubility of a surfactant cake is cedranone, which has the following structure:

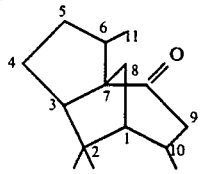

These solubility reducing agents may be used alone or in combination to slow the rate of dissolution and limit the absolute solubility of solid surfactant cakes as described hereinafter.

The composition may additionally contain 0% to 59.5% of optional ingredients as disclosed hereinafter.

DETAILED DESCRIPTION OF PREFERRED EMBODIMENTS

The description of preferred embodiments which follows is intended to describe the invention in detail and to enable those skilled in the art to practice the invention. The enumeration of specific preferred embodiments is not intended to limit the scope of the invention. Claims are provided at the end of this specification in order to describe what is considered herein to be the invention.

As indicated previously in the Summary section, the invention is a solid surfactant cake composition comprising: (A) 40% to 99.5% of a surfactant selected from certain anionic surfactants; (B) 0.5% to 20%, preferably 2% to 11%, and most preferably 3% to 7% of a solubility reducing agent as defined above; and 0% to 59.5% of specified optional ingredients as disclosed hereinafter. The nature of these components is discussed in order below.

SURFACTANT

One essential ingredient of surfactant cakes of the present invention is a suitable anionic surfactant.

Anionic surfactants operable in compositions suitable for use in the present invention can be broadly described as the water-soluble salts, particularly the alkali metal salts, of organic sulfuric acid reaction products having in their molecular structure an alkyl or alkaryl radical containing from about 8 to about 22 carbon atoms and a radical selected from the group consisting of sulfonic acid and sulfuric acid ester radicals. (Included in the term alkyl is the alkyl portion of higher acyl radicals.) Important examples of the anionic surfactants which can be employed in practicing the present invention are the sodium or potassium alkyl sulfates, especially those obtained by sulfating the higher alcohols ($C_8$–$C_{18}$ carbon atoms) produced by reducing the glycerides of tallow or coconut oil; sodium or potassium alkyl benzene sulfonates, in which the alkyl group contains from about 9 to about 15 carbon atoms, (the alkyl radical can be a straight or branched aliphatic chain); paraffin sulfonate surfactants having the general formula $RSO_3M$, wherein R is a primary or secondary alkyl group containing from about 8 to about 22 carbon atoms (preferably 10 to 18 carbon atoms) and M is an alkali metal, e.g., sodium, lithium or potassium; sodium alkyl glyceryl ether sulfonates, especially those ethers of the higher alcohols derived from tallow and coconut oil; sodium coconut oil fatty acid monoglyceride sulfates and sulfonates; sodium or potassium salts of sulfuric acid esters of the reaction product of one mole of a higher fatty alcohol (e.g., tallow or coconut oil alcohols) and about 1 to 10 moles of ethylene oxide; sodium or potassium salts of alkyl phenol ethylene oxide ether sulfates with about 1 to about 10 units of ethylene oxide per molecule and in which the alkyl radicals contain from about 8 to about 12 carbon atoms; the reaction products of fatty acids esterified with isethionic acid and neutralized with sodium hydroxide where, for example, the fatty acids are derived from coconut oil; sodium or potassium salts of fatty acid amides of a methyl tauride in which the fatty acids, for example, are derived from coconut oil and sodium or potassium β-acetoxy- or β-acetamido-alkanesulfonates where the alkane has from 8 to 22 carbon atoms.

A preferred class of anionic surfactants for use herein is that of alkali metal paraffin sulfonate surfactants as described above.

Paraffin sulfonate surfactants and methods for their preparation are well known in the art. They may be prepared, for example, by reaction of hydrocarbons with sulfur dioxide, oxygen and a sulfonation reaction initiator. Alternatively, they may be prepared by reacting an alkene and sodium bisulfite under suitable radiation or catalysis (See British Pat. No. 1,451,228, cited above in the Background Art section). Paraffin sulfonate surfactants are commercially available from Farbwerke Hoechst AG.

Preferred paraffin sulfonates to be used herein are secondary paraffin sulfonates, or mixtures of primary and secondary paraffin sulfonates in which secondary paraffin sulfonates predominate.

Examples of specific paraffin sulfonates useful herein are:

lithium-1-dodecane sulfonate,
sodium-6-tridecane sulfonate,
sodium-2-tetradecane sulfonate,
sodium-1-hexadecane sulfonate,
sodium-4-octadecane sulfonate, and
sodium-3-octadecane sulfonate.

Normally the paraffin sulfonates are available as mixtures of molecules having different chain lengths and sites of sulfonation within the above definition, and such mixtures are suitable for use herein. The paraffin sulfonates have excellent chemical stability in the presence of hypochlorite bleach. The sodium paraffin sulfonate surfactants are typically available in flaked solid form.

A second preferred type of surfactant within the above description is a linear alkyl benzene sulfonate surfactant wherein the alkyl portion contains about 11 to 13 carbon atoms. An example of this material is Calsoft F-90, available from Pilot Chemicals.

Another preferred anionic surfactant within the above description for use herein is a branched sodium alkyl sulfate surfactant wherein the alkyl group contains 12 to 15 carbon atoms. An example of this material is sulfated Neodol 25 Alcohol. The alcohol precursor of this material is available from Shell Chemical Company, Houston, Texas. This material can be sulfated in any one of the ways known to those skilled in the art of synthesizing surfactants.

SOLUBILITY REDUCING COMPOUNDS

The other essential component of the present invention is a solubility reducing compound, which may be provided in the proportions noted above. These compounds can be most broadly described as organic compounds which reduce the solubility of the anionic surfactant by at least 5%, preferably 25%, at room temperature (about 20° C.), as determined by the MIPS test set forth hereinafter in this specification. Several preferred materials which are useful herein as solubility reducing compounds are described below.

A first solubility reducing compound which is useful herein is one having one of the following structures:

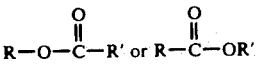

wherein R' represents a methyl or ethyl moiety, and wherein R represents an [m.n.o]bicycloalkane derivative having the following skeletal structure:

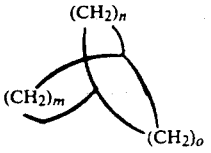

wherein m is from 2 to 3, n is from 1 to 2 and o is from 1 to 2. (It will be noted that while brackets are used in this specification to enclose the ring size reference numbers for bicycloalkane materials, these brackets will be replaced by parentheses in the claims.)

Bicycloalkanes of this type may be substituted at bridgehead sites or nonbridgehead sites, wherein a bridgehead site is defined as one of the points in the molecule at which the three lobes of the molecule come together, and wherein nonbridgehead sites are defined as all other carbon atoms of the skeletal structure. In the polycycloalkane materials which have been found to be useful herein as solubility reducing compounds, a nonbridgehead site of the R group as defined above is attached to the balance of the molecule.

Specific examples of bicycloalkane derivatives which are useful herein are as follows:

(1) [2.2.1]1,7,7-trimethyl-2-acetoxy heptane (isobornyl acetate):

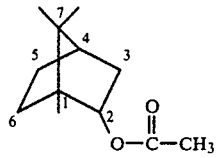

Isobornyl acetate is available from Rhodia, Inc., New York, New York.

(2) [3.1.1]7,7-dimethyl-4-acetoxymethyl bicycloheptane (myrtenyl acetate):

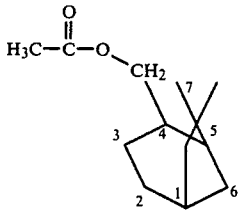

Myrtenyl acetate is available from Bush Boake Allen Ltd., London, England.

(3) [2.2.1]bicyclo-1,3,3-trimethyl-2-acetoxy heptane (fenchyl acetate):

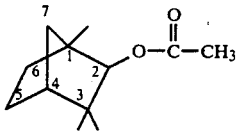

This material is commercially available from Berje Chemical Products, Inc., Long Island City, New York.

(4) [5.2.1.0$^{2,6}$]tricyclo-10,10-dimethyl-8-propionyloxy-dec-3-ene (frutene):

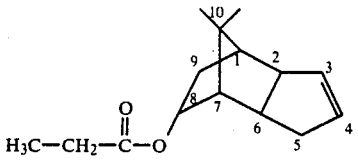

Frutene is available from International Flavors and Fragrances, Inc., New York, New York.

(5) [2.2.1]bicyclo-2-propionyloxy-1,7,7-trimethyl heptane (isobornyl propionate):

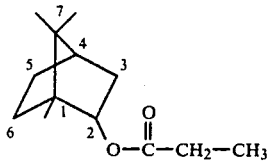

Isobornyl propionate is available from Norda, Inc., East Hanover, New Jersey.

(6) [5.3.1.0$^{3,7}$]tricyclo-2,2,6,10-tetramethyl-10-acetoxy undecane (cedrenyl acetate):

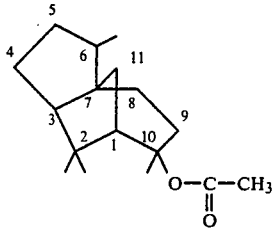

Cedrenyl acetate is available from International Flavors and Fragrances, Inc., New York, New York.

It will be noted that certain of these compounds (frutene and cedrenyl acetate) are, strictly speaking, tricycloalkanes. However, inspection of these molecules will reveal that they have the functional characteristics of the bicycloalkane generic class of the present invention. Specifically, the frutene molecule can be viewed as a derivative of [2.2.1]bicyclo-3-propoxy-7,7-dimethyl heptane, which is fused at its No. 5 and No. 6 carbon atoms to a cyclopentene ring. Likewise, cedrenyl acetate can be thought of as a derivative of [3.2.1]bicyclo-4-acetoxy-4,6,6-trimethyl octane, to which a methyl cyclopentene moiety is fused at the No. 7 and No. 3 carbon atoms of the bicyclo skeleton. Also, the molecules defined herein may have sites of unsaturation in their skeletal structures without departing from the present invention. Thus, when a skeletal structure is specified herein to describe the compounds which are within the present invention, the molecule must have the structures described, but can also have additional structural features to the extent that the latter additional features do not interfere with the solubility reducing function of the molecule.

A second class of materials which may be used to reduce solubility in accordance with the present invention are materials having one of the following structures:

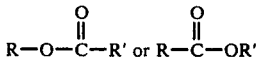

wherein R′ is a methyl or ethyl moiety and R is a derivative of [4.4.0]trans-decalin having the following skeletal structure:

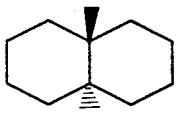

It will be noted that this structure, which is a bicyclo compound, has two bridgehead carbon atoms and eight nonbridgehead carbon atoms. A nonbridgehead carbon atom of the R moiety, which may be the No. 2, 3, 4, 5, 7, 8, 9, or 10 carbon of the trans-decalin skeleton, is attached to the balance of the molecule. It will be noted that the atoms attached to the bridgehead carbon atoms of the decalin moiety are arranged in trans orientation. (In the notation used above, a solid triangle indicates a carbon to substituent bond which is shown to be protruding substantially outwardly from the plane of the figure, while a shaded triangle indicates a carbon to substituent bond which is shown to protrude substantially behind the plane of the figure.)

An example of a trans-decalin derivative which is useful in the context of the present invention is tricyclo[8.4.0.0$^{4,9}$]-6-isopropyl-10,14-dimethyl-14-carbomethoxytrans-tetradeca-3,5 diene (pine resin, or the methyl ester of abietic acid):

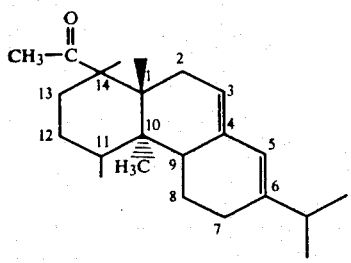

Again, it will be noted that the presence of an additional ring fused to the trans-decalin skeletal structure does not interfere with the functionality of pine resin as a solubility reducing agent within the present invention. This compound is available from Amsco Solvents and Chemical Company, Palatine, Illinois.

A third class of compounds which are useful herein to reduce the solubility of surfactant cakes are compounds having one of the following formulas:

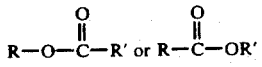

where R′ is a methyl or ethyl moiety and R is a derivative of cyclohexane having the following skeletal structure:

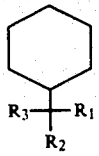

wherein $R_1$, $R_2$ and $R_3$ are each selected from an ethyl, methyl or propyl moiety, and wherein the balance of the molecule is attached to the 2, 3, 4, 5 or 6 position of the cyclohexane ring of said R moiety. Specific examples of such compounds are 1-acetoxy-2(1,1-dimethyl-n-propyl)cyclohexane:

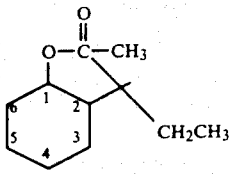

and 1-tertiary butyl-4-acetoxy cyclohexane:

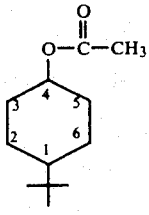

The former cyclohexane compound is also known as Coniferan, and is available from International Flavors and Fragrances, Inc. The latter cyclohexane compound described above is commercially available from the same source.

A fourth type of compound which is useful herein to reduce the solubility of a surfactant cake has one of the following molecular structures:

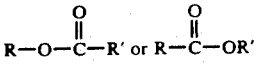

wherein R′ may be methyl or ethyl and R is an n-nonyl moiety.

An example of this material is n-nonyl acetate:

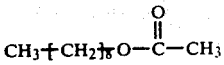

This material is commercially available from International Flavors and Fragrances, Inc.

Finally, an additional material which may be used to reduce the solubility of surfactant cakes in accordance with the present invention is tricyclo[5.3.1.0$^{3,7}$]2,2,6,10-tetramethyl-8-oxo-undecane (cedranone):

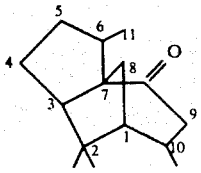

This material is commercially available from International Flavors and Fragrances, Inc.

The amount of solubility reducing agent in the compositions of the invention will range from about 0.5% to about 20%. In any composition the amount of the given solubility reducing agent will be present in an amount sufficient to reduce the MIPS solubility by at least 5%, preferably by at least 25%. The determination of this solubility reduction is explained hereinafter in connection with the description of the MIPS test.

It will be noted that the above description defines several types of materials which have been found to be useful for reducing the solubility of surfactant cakes in accordance with the present invention. With the exception of the nonyl compounds and cedranone, these materials have in common the properties of a medium bulk monocyclic or bicyclic rigid backbone to which is attached an acetoxy or methyl ester moiety. (The nonyl compounds described above have the acetoxy or methyl ester moiety but not the sterically hindered rigid backbone, while the cedranone described above has the polycyclic rigid backbone of the other compounds but an oxo- moiety instead of an acetoxy or methyl ester moiety.) It is believed that the compounds which comprise a rigid, sterically hindered backbone with an acetoxy or methyl ester functionality reduce the solubility of surfactants in water because the lipophilic rigid cyclic structure is sized to fit in the center of a detergent micelle, while the slightly hydrophilic methyl ester or acetate moiety extends toward the outside of the micelle, and thus toward the water contacting surface of the micelle. A ring structure which lacks rigidity, and is thus flexible, may be able to conform to the micelle interior, which would seem to allow the micelle to better solubilize itself in water. If the acetoxy or methyl ester moiety was modified to be more or less hydrophilic, it is believed that the resulting solubility reducing compound molecule would be better adapted to the micelle and would result in greater solubilization of the surfactant in water. The theory is tentative, and does not completely explain the present invention, although it is believed to be useful in understanding the present invention at the micelle level. This theory is not intended to limit the scope of the invention, and in fact the scope of the invention as disclosed herein is somewhat greater than the scope of the theory.

OPTIONAL COMPONENTS

While compositions within the scope of the present invention can be made up entirely of a surfactant and a solubility reducing agent as described above, it is highly desirable to include additional ingredients in the composition. Such ingredients may include, but are not limited to, perfumes, dyes, manganese stain inhibiting materials, bleach activators, and diluent materials. It will be noted that for several of the optional components as described below, interaction of the components with hypochlorite bleaches, or stability of the components with respect to hypochlorite bleaches are highly desired. The reason for this will become more apparent when a highly preferred mode of use of the present surfactant cakes is described wherein a hypochlorite solution and a surfactant-containing aesthetic solution are dispensed to a toilet from separate dispensers formed as an integral unit. What follows is a description of the individual optional components which may be added to surfactant cakes of the present invention.

MANGANESE STAIN PREVENTING AGENTS

A dark, tenacious stain is sometimes observed in toilet bowls in geographical areas where an appreciable quantity of manganese is provided to toilet bowls by the connecting water supply. In particular, this problem is observed when toilets which receive such high manganese water are also charged with hypochlorite solutions, as described below in a preferred mode of practicing the present invention. This problem may be reduced by including in the composition of the surfactant cake of the present invention 5% to 30% of a manganese stain inhibiting agent, which may be selected from partially hydrolyzed polyacrylamides having a molecular weight of about 2000 to about 10,000, polyacrylates with a molecular weight of about 2000 to about 10,000, and copolymers of ethylene and maleic acid anhydride with a molecular weight of from about 20,000 to about 100,000. A further description of the problems of manganese staining and of the manganese stain inhibiting agents is found in the following patent applications: U.S. Ser. No. 28,612, filed by Kurtz on Apr. 9, 1979; U.S. Ser. No. 28,293, filed by Callicott on Apr. 9, 1979; and U.S. Ser. No. 28,613, filed by Callicott on Apr. 9, 1979. The immediately preceding applications are hereby incorporated herein by reference, and are owned by the owners of the present application and invention.

DYES

While it is appreciated that no dye is essential to the operation of the present invention, it is desirable to incorporate a dye in the surfactant cake in order to color the water of a toilet bowl, both to indicate the presence or absence of cleaning ingredients and to improve the toilet aesthetically. Either of two types of dyes may be incorporated into compositions of the present invention in order to improve toilet bowl aesthetics or to signal the presence or absence of active ingredients in the water of the toilet bowl.

A first type of dye which may be used herein is a dye which is relatively stable to hypochlorite solutions, so that its color persists despite the presence in the toilet bowl of a concentration of hypochlorite which is effective to maintain sanitary conditions. Such dyes are described in a commonly owned U.S. Patent Application. Ser. No. 972,318, filed by Kitko on Dec. 22, 1978, which is hereby incorporated herein by reference.

A second type of dye which may be incorporated in a surfactant cake for use herein is one which initially dyes the toilet bowl water, but which is bleached to a colorless state responsive to the presence of a sanitizing concentration of hypochlorite. Such a system allows the consumer to evaluate whether a dispenser which is intended to dispense hypochlorite and surfactant ingredients from separate sources is in fact dispensing both ingredients. In this dye system a color which initially appears is indicative of the dispensing of surfactants, since the surfactant and dye are part of the same cake of ingredients. The gradual disappearance of this color indicates that hypochlorite is being dispensed to the bowl at a concentration which is effective to bleach the dye. Such a dye system is described in a commonly owned U.S. Patent Application, Ser. No. 915,027, filed by Kitko on June 12, 1978, which is hereby incorporated herein by reference.

PERFUMES

Perfumes selected for use in the compositions of the present invention should be stable to hypochlorite in the environment of preferred use, and should be sufficiently potent that the indicated percentage by weight of perfume will supply to the water of the toilet an aesthetically desirable concentration of perfume in the head space immediately adjacent the water of the toilet tank and bowl.

PROCESSING AIDS AND OTHER MATERIALS

Various materials may be incorporated in the surfactant cake of the present invention in order to dilute the dry ingredients to a consistency which may be easily worked in conventional blending equipment. Examples of such materials are sodium chloride and other materials of a similar nature. Desired materials of this type are inexpensive and water-soluble, and are stable with respect to all of the components of the surfactant cake.

Another particularly desirable material to add to the surfactant is sodium bromide. This material serves as a catalyst to improve the rate at which a hypochlorite solution separately dispensed to a toilet bowl will decolorize the bleachable dye system described above under low pH conditions.

SURFACTANT CAKE MANUFACTURE AND USE

The manufacture of solid cakes from the compositions of the present invention is well within the capability of persons of ordinary skill in the art of forming bars of toilet soap. The surfactant cakes of the present invention as described herein were manufactured by mixing the raw materials into a homogeneous mass and noodling, plodding, extruding, cutting and stamping the mass to form uniform bars or cakes sized to fit within the preferred dispensers described as preferred surfactant dispensers in the patent application of Wages, U.S. Ser. No. 897,479, which is incorporated by reference above.

In a particularly preferred embodiment of the present invention, the surfactant cake composition described above is adapted to be dispensed from a passive dosing dispenser as described in a U.S. Patent Application, Ser. No. 897,479, filed by Dwight Wages on Apr. 18, 1978. This application refers to the following patent applications: U.S. Ser. No. 897,469, filed Apr. 18, 1978, by Robert Dirksing; and U.S. Ser. No. 897,477, filed Apr. 18, 1978, by Robert Dirksing. These applications are hereby incorporated herein by reference; they are owned by the owners of the present application. Such dispensers are particularly preferred because they may contain a cake or cakes of solid ingredients which are exposed to water to form a cleaning, disinfecting, or aesthetic (hereinafter: cleaning) solution which is kept in isolation from the water of the toilet tank until the toilet is flushed. At this time, the preferred dispensers provide a measured quantity of the cleaning solution to the toilet flush water in order to produce a fairly constant level of the cleaning ingredients within the water of the toilet bowl at all times. In this context, the quantity of a surfactant cake composition which is released to the toilet is adjusted so that the concentration of the cake composition in the toilet bowl is between roughly 2 ppm and 30 ppm.

In the ordinary practice of the invention an oxidizing agent (e.g., a hypochlorate solution) is supplied to the toilet bowl water from a dispensing means separate from that which dispenses the ingredients of the above-described cake. This is done to prevent prolonged contact between high concentrations of the oxidizing agent and the ingredients of the surfactant cake prior to their dispensation to the toilet. In certain instances, however, the oxidizing material may be codispensed with other ingredients, or may even be present in the water as supplied to the toilet from a public or private water supply, for example, water which has been chlorinated.

Hypochlorite ions may be supplied to the toilet bowl by any of a wide variety of compounds. Specific examples of compounds of this type include sodium hypochlorite, potassium hydrochlorite, lithium hypochlorite, calcium hyochlorite, calcium hypochlorite dihydrate, monobasic calcium hypochlorite, dibasic magnesium hypochlorite, chlorinated trisodium phosphate dodecahydrate, potassium dichloroisocyanurate, sodium dichloroisocyanurate, sodium dichloroisocyanurate dihydrate, 1,3-dichloro-5,5-dimethylhydantoin, N-chlorosulfamide, chloramine T, dichloroamine T, chloroamine B, and dichloroamine B. Preferred sanitizing agents are calcium hypochlorite, lithium hypochlorite, and mixtures thereof. A particularly preferred sanitizing agent suitable for use in the practice of the present invention is described in the commonly assigned U.S. Patent Application filed by Nyquist et al., entitled PASSIVE DOSING DISPENSER WITH IMPROVED HYPOCHLORITE CAKE, Ser. No. 019,547, filed Mar. 12, 1979, said patent application being incorporated herein by reference. As indicated in the Nyquist application, the sanitizing material in compounded into a separate cake which is contacted with toilet tank water in an entirely separate dispenser. The dispenser for the surfactant cake and for the hypochlorite cake are desirably molded as a single integral unit, as by thermoforming shells and assembling them as indicated in the Nyquist application. Means are thus provided to dispense at least 3 ppm (parts per million), preferably about 5 ppm to 10 ppm of available chlorine (in the form of hypochlorite) to the water of a toilet while concurrently dispensing the indicated proportions of the surfactant cake of the present invention to the toilet tank water.

EXAMPLES

The examples which follow illustrate the practice of the present invention and exemplify a variety of compositions within the claims. Two tests have been devised in order to illustrate the solubility reducing benefits of materials of the present invention, and a correlation between the two tests has been devised to show that they are essentially equivalent.

A first, and most direct, method of measuring the solubility reducing benefit of the present invention is known herein as the plug dissolution test. In this test solid samples of a surfactant cake (known hereinafter as "plugs") are immersed in distilled water for a measured length of time varying between 5 minutes and 16 hours, and the amount of the overall composition dissolved in water during immersion is measured. The result of this test is a table of percent of the surfactant cake composition in solution vs. time. (Concentrations are expressed herein as grams of solute per 100 grams of solution unless otherwise indicated.)

To perform the plug dissolution test sample plugs of the surfactant cake's composition are supplied which are approximately 2.1 cm. by 2.5 cm. by 1 cm. (The first two dimensions may change slightly, since the plugs are shaved as necessary to produce a surfactant plug which weighs 7.5±0.1 grams.) Each plug to be tested is then pierced with a flat-headed screw through its center so that the head barely touches the surface of one side of the plug and so that the point of the screw protrudes from the other side of the plug. A flatheaded screw is used so that the plug may be supported by the head of the screw and thus spaced away from the surface which supports it.

Each plug to be tested is first soaked in a preconditioning solution for 90 minutes in order to hydrate the plug without appreciably dissolving it. This hydration without appreciable dissolution is accomplished by providing a preconditioning solution which is supersaturted with respect to a mixture of sodium paraffin sulfonate, sodium bromide, and the perfume desired. In these examples the preconditioning solution consisted of 172 grams of sodium paraffin sulfonate, 6 grams of sodium bromide, and 22 grams of perfume diluted to 1 liter with distilled water. The preconditioning solution described is cloudy, indicating that it is supersaturated.

After the plugs are preconditioned, they are moved to 50 milliliter beakers containing 15 milliliters of distilled water, one plug per beaker. The plugs are handled by the points of the screws in order to prevent the solution on the plug from being wiped off when the plugs are manipulated. The plugs remain immersed in the beaker containing distilled water for a measured period of time, and are then removed.

Since each initial plug contains a known amount of dye, it is possible to determine the concentration of each plug in solution by measuring the concentration of dye in solution using a spectrophotometric method. To do this, the liquid sample is first diluted by a known amount so that its measured absorbancy will be between 0.1 and 0.5. The absorbancy of the sample is read on the Spectronic-20 spectrophotometer machine (available from Bausch and Lomb, Inc., Rochester, New York) at a wave length of 620 nanometers using a one inch cell. A formula is then derived as follows to calculate the concentration of the plug in solution:

(1) $A = Elc/d$ (Beer's Law)

A is absorbancy
E is the extinction coefficient for a particular dye
l is the path length of the spectrophotometer cell
c is the concentration of dye in solution
d is a dilution factor In this experiment the path length l is 1.0 inch (2.54 cm.), dye concentration c is measured in milligrams of dye per kilogram of solution, and the extinction coefficient E for Acid Green #3 dye is calculated to be 0.227 (kg. solution)/(mg dye) (inches path length). The absorbancy equation may thus be substituted as follows:

$$A = \frac{(.227 \frac{\text{kg}}{\text{mg.in.}})(1.0 \text{ in.})\, c}{d} \quad (2)$$

To convert concentration c to milligrams of dye x the following conversion factor is applied:

$$x \text{ (mg. dye)} = c\left(\frac{\text{mg. dye}}{\text{kg. sample}}\right)(.015 \text{ kg. sample size}) \quad (3)$$

Equation (3) is then substituted into equation (2) in order to compute the weight (mg.) of dye in the sample:

(b 4) $x = Ad(0.015 \text{ kg.})/0.227$

To determine the concentration of the entire plug in solution (in grams per 100 grams of solution), the concentration calculated in equation (3) is multiplied by a conversion factor relating dye weight to plug weight:

$$K = x \frac{(100\text{g. solution})}{(15\text{g. solution})} \frac{(100 \text{ grams plug})}{(y \text{ grams dye in plug})} \frac{(1 \text{ gram})}{(1000 \text{ mg.})} \quad (5)$$

K is the plug concentration in solution (grams per 100 grams of solution)
c is as defined above
y is the amount of dye in 100 parts by weight of the surfactant plug (6) $K = 0.666\,(x/y)$ In the exampes below, y is 4.3 parts of dye for a 100 part plug, so equation (6) may be further reduced:

(7) $K = (0.666)x/4.3$ (8) $K = 0.155x$

Plug concentration is directly derived from absorbancy by combining equations (4) and (8):

(9) $K = (0.155)(0.015)Ad/(0.227)$

(10) $K = (0.0102)Ad$

A second, simpler test has been devised to demonstrate the solubility of surfactant plugs and their components provided in accordance with the present invention. This test is known hereinafter as a "maximum isotropic phase solution" (MIPS) test. The nature of this test is as follows:

A sample of each component of a surfactant cake to be tested is obtained in a quantity sufficient to make a surfactant cake having a particular weight. First, the sample of the surfactant ingredient is put into a suitable container, and distilled water is added in small increments with stirring until the solution, which is initially cloudy, becomes clear. This concentration of surfactant, measured in grams per 100 grams of solution, is then multiplied by the weight of the surfactant cake and divided by the number of grams of surfactant intended for the surfactant cake. The resulting number is the MIPS concentration of the pure surfactant in water.

To the clear solution of surfactant in water produced above is added the amount of a second component of the surfactant cake which would be found in a surfactant cake having the composition being tested. (Herein, the second component is chosen to be sodium bromide.) The solution will again be observed to become cloudy, because sodium bromide somewhat reduces the solubility of the surfactant in water. Water is again added in small increments with stirring. When the solution again becomes clear, the number of grams of surfactant per 100 grams of solution is again calculated. The same process of adding each sequential ingredient and then adding water in increments to reduce the solution concentration to the MIPS concentration is repeated for each ingredient until all of the ingredients which affect surfactant solubility have been added. In the present case, it has been found that the addition of Acid Green #3 dye does not change the solubility of the surfactant. Dye is not included as a component in this test, as it would interfere with the visual observtions of solution clarity.

Effects on the MIPS concentration of a surfactant composition as additional components are added to the tested composition may be measured as a percent MIPS solubility reduction. This solubility reduction is defined herein as follows:

$$\text{Reduction in solubility} = 100\% \ (1-(m/n))$$

m is solubility with the solubility reducing agent
n is solubility without the solubility reducing agent
For example, if the surfactant has a MIPS solubility of 50 grams per 100 grams solution, and the addition of the solubility reducing agent reduces the solubility to 40 grams per 100 grams solution, the percent solubility reduction is 20%.

An illustration of how the MIPS test works follows:

A surfactant cake weighing 101.2 grams was hypothesized which would contain 81.8 grams of sodium paraffin sulfonate, 2.9 grams sodium bromide, 3.5 grams of perfume and 13.0 grams of isobornyl acetate (IBA). The indicated quantities of each ingredient were weighed out separately. First, 81.8 grams of the sodium paraffin sulfonate surfactant were placed in a beaker and diluted just enough to produce a clear solution. The solution was found to weigh 234 grams. Then 2.9 grams of sodium bromide were then added to the clear surfactant solution, making it cloudy. Water was again added until the solution was clear, at which time the total solution weight was 247 grams. Perfume was then added to the mixture, which again made the water cloudy. Additional water was added until the solution was clear, resulting in a total of 349 grams of solution. Finally, the 13 grams of isobornyl acetate were added to the mixture and just enough water was added to make the mixture clear. At this point, the total amount of solution was 920 grams. The MIPS concentrations were calculated using the following formula:

$$\text{MIPS concentration} = 100\% \times \frac{\text{(grams of surfactant)}}{\text{(solution weight)}} \ \frac{\text{(hypothetical plug weight)}}{\text{(surfactant weight)}} \quad (11)$$

In the present illustration the equation was reduced as follows by substituting known numbers and canceling the two surfactant weight terms:

$$\text{MIPS} = 100\% \times \frac{101.2 \text{ grams}}{\text{(solution weight)}} \quad (12)$$

The solution weights above can be substituted into Equation (12) to determine the MIPS values as each ingredient is successively added:

$$\text{MIPS of surfactant alone} = 100\% \times \frac{101.2}{234} \quad (13)$$

$$= 43\% \quad (14)$$

$$\text{MIPS of surfactant + NaBr} = \frac{100\% \ (101.2)}{247} \quad (15)$$

$$= 41\% \quad (16)$$

$$\text{MIPS of surfactant + NaBr + perfume} = \frac{100\% \ (101.2)}{349} \quad (17)$$

$$= 29\% \quad (18)$$

$$\text{MIPS of complete surfactant cake} = \frac{100\% \ (101.2)}{920} \quad (19)$$

$$= 11\% \quad (20)$$

To demonstrate the essential equivalence of the plug dissolution test and the MIPS test, compositions A through D were formulated as shown in Table 1:

TABLE 1

| Component | Formula A | Formula B | Formula C | Formula D |
|---|---|---|---|---|
| Sodium paraffin sulfonate | 81.8g. | 65.8g. | 65.8g. | 85.3g. |
| Perfume | 11.0 | 11.0 | 9.0 | 7.5 |
| Acid Green 3 dye | 4.3 | 4.3 | 4.3 | 4.3 |
| Sodium bromide | 2.9 | 2.9 | 2.9 | 2.9 |
| P-35* | — | 16.0 | 16.0 | — |
| Isobornyl acetate | — | — | 2.0 | — |
| Net weight | 100.0g. | 100.0g. | 100.0g. | 100.0g. |

*A polyacrylamide polymer having an average molecular weight of 7000 atomic mass units, wherein about 80% of the acrylamide moieties have been hydrolyzed to form carboxylic acid or carboxylate moieties. This material is available from the American Cyanamid Company, Wayne, New Jersey.

Each test was run as described, except that only the dissolution test result for 16 hours was used, and the MIPS concentration was run only for a composition containing all the ingredients noted for each formula, rather than in sequential steps. The results of these runs were as reported in Table 2:

TABLE 2

| Test Result | Formula A | Formula B | Formula C | Formula D |
|---|---|---|---|---|
| % Plug in Solution, (grams per 100 g. of solution) | 13.5–15.8 | 5.9 | 6.8 | 19.7 |
| MIPS Concentration (grams per 100 g. of solution) | 14.5±1.5 | 6.3±0.5 | 7.5±0.8 | 18±2 |

To show that in 16 hours an essentially saturated solution of the surfactant cake's components was achieved when practicing the dissolution test, the following dissolution values were noted for the plug dissolution test when performed for various lengths of time as shown in Table 3 below:

TABLE 3

| Time | (Composition A) % Plug in Solution* |
|---|---|
| 5 min. | 0.7 |
| 10 min. | 1.3 |
| 20 min. | 2.3 |
| 30 min. | 3.5 |
| 45 min. | 4.9 |
| 1 hour | 6.1 |
| 2 hours | 7.6 |
| 4 hours | 9.4 |
| 6 hours | 10.6 |
| 16 hours | 13.5 |

*Expressed in grams per 100 ml. of solution.

EXAMPLE I

In this example, hypothetical plugs were formulated which, when complete, would comprise 81.8 grams of sodium paraffin sulfonate surfactant, 2.9 grams of sodium bromide, 3.5 grams of perfume, and an amount of isobornyl acetate which varied between 0.5 grams and 13 grams. The MIPS concentrations for various compositions and subcompositions containing some or all of these materials are reported in Table 4 below. It will be noted that the particular perfume used also has an appreciable effect on solubility, although the effect is not as great as when isobornyl acetate is added.

TABLE 4

| Measurement | Plug Composition (g.)* 1 | 2 | 3 | 4 | MIPS Concentration (%) |
|---|---|---|---|---|---|
| A | 81.8 | 0 | 0 | 0 | 43 |
| B | 81.1 | 2.9 | 0 | 0 | 41 |
| C | 81.8 | 2.9 | 0 | 0.5 | 39 |
| D | 81.8 | 2.9 | 0 | 11.0 | 13 |
| E | 81.8 | 2.9 | 0 | 14.0 | 11 |
| F | 81.8 | 2.9 | 3.5 | 0 | 29 |
| G | 81.8 | 2.9 | 3.5 | 0.5 | 27 |
| H | 81.8 | 2.9 | 3.5 | 7.0 | 15 |
| I | 81.8 | 2.9 | 3.5 | 13.0 | 11 |

*1 is a sodium paraffin sulfonate surfactant
2 is sodium bromide
3 is perfume
4 is isobornyl acetate

EXAMPLE II

The procedure of Example I was followed, except that the surfactant used was a linear alkyl benzene sulfonate with an alkyl group having 11 to 13 carbon atoms, marketed as Calsoft F-90. The results of this test are summarized in Table 5.

TABLE 5

| Measurement | Plug Composition (g.)* 1 | 2 | 3 | 4 | MIPS concentration (%) |
|---|---|---|---|---|---|
| A | 81.8 | 0 | 0 | 0 | 50 |
| B | 81.8 | 2.9 | 0 | 0 | 33 |
| C | 81.8 | 2.9 | 0 | 2.0 | 27 |
| D | 81.8 | 2.9 | 0 | 11.0 | 5 |
| E | 81.8 | 2.9 | 3.5 | 0 | 23 |
| F | 81.8 | 2.9 | 3.5 | 0.5 | 21 |
| G | 81.8 | 2.9 | 3.5 | 3.0 | 12 |

*1 is Calsoft F-90 (LAS surfactant)
2 is sodium bromide
3 is perfume
4 is isobornyl acetate

EXAMPLE III

The tests of Examples I and II were repeated, substituting as the surfactant a branched sodium alkyl ($C_{12}$–$C_{15}$) sulfate, known to the trade as Neodol 25 Alcohol Sulfate. The results are summarized in Table 6.

TABLE 6

| Measurement | Plug Composition (g.)* 1 | 2 | 3 | 4 | MIPS Concentration (%) |
|---|---|---|---|---|---|
| A | 81.8 | 0 | 0 | 0 | 13 |
| B | 81.8 | 2.9 | 0 | 0 | 13 |
| C | 81.8 | 2.9 | 0 | 2.0 | 11 |
| D | 81.8 | 2.9 | 0 | 11.0 | 6 |
| E | 81.8 | 2.9 | 3.5 | 0 | 11 |
| F | 81.8 | 2.9 | 3.5 | 1.0 | 10 |
| G | 81.8 | 2.9 | 3.5 | 7.0 | 9 |

*1 is Neodol 25 Alcohol Sulfate
2 is sodium bromide
3 is perfume
4 is isobornyl acetate

EXAMPLE IV

In this example the solubility reducing effects of a large number of components were tested, using the MIPS method. In a first run, the MIPS was measured for a mixture of 81.8 grams of sodium paraffin sulfonate surfactant, 2.9 grams of sodium bromide, and 11 grams of the component being tested. The control composition contained the surfactant and sodium bromide only. In the second run of the experiment the MIPS measurement was made on a composition containing 81.8 grams of sodium paraffin sulfonate surfactant, 2.9 grams of sodium bromide, 3.5% perfume, and 7.5% of certain of the solubility reducing components. The control composition for run 2 contained the surfactant, sodium bromide, and perfume only. The results of this test are summarized in Tables 7 and 8 below.

TABLE 7

| Solubility Reducing Component | MIPS** Run 1 | Control |
|---|---|---|
| Isobornyl Acetate | 13 | 41 |
| Coniferan | 21 | 41 |
| Myrtenyl Acetate | 13 | 41 |
| 4-Tertiary Butyl Cyclohexyl Acetate | 9 | 41 |
| Cedrenyl Acetate | 19 | 41 |
| Fenchyl Acetate | 21 | 41 |
| Abietic Acid, Methyl Ester | 6 | 41 |
| Frutene | 23 | 41 |
| isobornyl Propionate | 21 | 41 |
| Cedranone | 13 | 41 |
| Nonyl Acetate | 11 | 41 |

**Grams per 100 ml. of solution

TABLE 8

| Solubility Reducing Component | MIPS Run 2 | Control |
|---|---|---|
| Isobornyl Acetate | 13 | 29 |
| Coniferan | 21 | 29 |
| Frutene | 21 | 29 |
| Isobornyl Propionate | 21 | 29 |
| Cedranone | 15 | 29 |

I claim:

1. A solid, water dispersible composition comprising:

A. 40% to 99.5% of an anionic surfactant selected from the group consisting of the organic sulfates and sulfonates having surface active properties;

B. 0% to 59.5% of optional ingredients selected from the group consisting of perfumes, dyes, manganese stain inhibiting materials, bleach activators, diluent materials, and mixtures thereof; and C. 0.5% to 20% of a solubility reducing agent selected from the group consisting of:

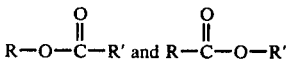

wherein R′ is selected from methyl or ethyl and R is selected from:

i. An (m.n.o)bicycloalkane derivative having the following skeletal structure:

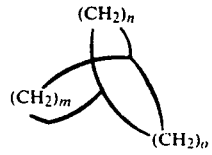

wherein m is from 2 to 3, n is from 1 to 2, and o is from 1 to 2, and wherein a nonbridgehead site of said R moiety is attached to the balance of the molecule;

ii. A derivative of (4.4.0)bicyclo-trans-decalin having the following skeletal structure:

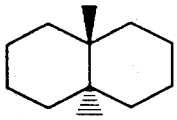

wherein a nonbridgehead site of said R moiety is attached to the balance of the molecule;

iii. A derivative of cyclohexane having the following skeletal structure:

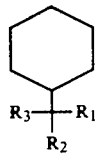

wherein $R_1$, $R_2$ and $R_3$ are each selected from an ethyl, methyl, or propyl moiety, and wherein the balance of the molecule is attached to the non-l position of the cyclohexane ring of said R moiety; and iv. An n-nonyl moiety.

2. The invention of claim 1 wherein said anionic surfactant is selected from the group consisting of alkali metal paraffin sulfonates, linear alkyl benzene sulfonates having an alkyl chain length of about 11 to 13 carbon atoms, and branched sodium alkyl sulfates having an alkyl chain length of 12 to 15 carbon atoms.

3. The invention of claim 2 wherein said anionic surfactant is a sodium paraffin sulfonate surfactant.

4. The invention of claim 3 wherein said anionic surfactant comprises about 82% of said composition.

5. The invention of claim 1 wherein said solubility reducing agent is selected from the group consisting of isobornyl acetate, myrtenyl acetate, 4-tertiary butyl cyclohexyl acetate, methyl ester of abietic acid, n-nonyl acetate, fenchyl acetate, frutene, isobornyl propionate, cedrenyl acetate, 1-acetoxy-2(1,1-dimethyl-n-propyl)-cyclohexane, and 1-tertiary butyl-4-acetoxy cyclohexane.

6. The invention of claim 5 wherein said solubility reducing agent is selected from a group consisting of isobornyl acetate, myrtenyl acetate, 4-tertiary butyl cyclohexyl acetate, methyl ester of abietic acid, and n-nonyl acetate.

7. The invention of claim 6 wherein said solubility reducing agent is isobornyl acetate.

8. A solid, water dispersible composition comprising:

A. 40% to 99.5% of an anionic surfactant selected from the group consisting of the organic sulfates and sulfonates having surface active properties;

B. 0% to 59.5% of optional ingredients selected from the group consisting of perfumes, dyes, manganese stain inhibiting materials, bleach activators, diluent materials and mixtures thereof; and C. 0.5% to 20% of cedranone.

9. The invention of claim 8 wherein said anionic surfactant is selected from the group consisting of alkali metal paraffin sulfonates, linear alkyl benzene sulfonates having an alkyl chain length of about 11 to 13 carbon atoms, and branched sodium alkyl sulfates having an alkyl chain length of 12 to 15 carbon atoms.

10. The invention of claim 9 wherein said anionic surfactant is a sodium paraffin sulfonate surfactant.

11. A composition adapted to deliver ingredients to a toilet bowl comprising:

A. 40% to 99.5% of an anionic surfactant selected from the group consisting of the organic sulfates and sulfonates having surface active properties;

B. 0% to 59.5% of optional ingredients selected from the group consisting of perfumes, dyes, manganese stain inhibiting materials, bleach activators, diluent materials and mixtures thereof; and C. 0.5% to 20% of a solubility reducing agent selected from the group consisting of:

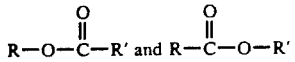

wherein R′ is selected from methyl or ethyl and R is selected from:

i. An (m.n.o)bicycloalkane derivative having the following skeletal structure:

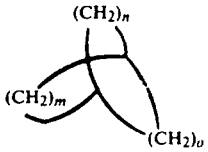

wherein m is from 2 to 3, n is from 1 to 2, and o is from 1 to 2, and wherein a nonbridgehead site of said R moiety is attached to the balance of the molecule;

ii. A derivative of (4.4.0)bicyclo-trans-decalin having the following skeletal structure:

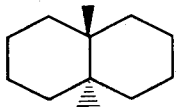

wherein a nonbridgehead site of said R moiety is attached to the balance of the molecule;

iii. A derivative of cyclohexane having the following skeletal structure:

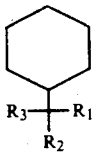

wherein $R_1$, $R_2$ and $R_3$ are each selected from an ethyl, methyl, or propyl moiety, and wherein the balance of the molecule is attached to the non-l position of the cyclohexane ring of said R moiety; and iv. An n-nonyl moiety.

12. The composition of claim 11 wherein said anionic surfactant is selected from the group of surface active agents consisting of alkali metal paraffin sulfonates, linear alkyl benzene sulfonates having an alkyl chain length of about 11 to 13 carbon atoms, and branched sodium alkyl sulfates having an alkyl chain length of 12 to 15 carbon atoms.

13. The composition of claim 12 wherein said anionic surfactant is a sodium paraffin sulfonate surfactant.

14. The composition of claim 13 wherein said anionic surfactant comprises about 82% of said composition.

15. The composition of claim 10 wherein the solubility reducing agent is selected from a group consistig of isobornyl acetate, myrtenyl acetate, 4-tertiary butyl cyclohexyl acetate, methyl ester of abietic acid, n-nonyl acetate, fenchyl acetate, frutene, isobornyl propionate, cedrenyl acetate, 1-acetoxy-2(1,1-dimethyl-n-propyl)-cyclohexane, and 1-tertiary butyl-4-acetoxy cyclohexane.

16. The composition of claim 15 wherein said solubility reducing agent is selected from a group consisting of isobornyl acetate, myrtenyl acetate, 4-tertiary butyl cyclohexyl acetate, methyl esters of abietic acid, and n-nonyl acetate.

17. The composition of claim 16 wherein said solubility reducing agent is isobornyl acetate.

18. In an integrated toilet tank dispenser with independent first and second dispensing means, wherein said first dispensing means is adapted to dispense ingredients which provide at least 3 ppm of available chlorine to the water of a toilet bowl, and wherein said second dispensing means is adapted to receive a cake of ingredients and to dispense a sufficient portion of said cake of ingredients to a toilet to provide 2 ppm to 30 ppm of said ingredients to a toilet bowl, the improvement wherein said cake of ingredients is a solid cake comprising:

A. 40% to 99.5% of an anionic surfactant selected from the group consisting of the organic sulfates and sulfonates having surface active properties;

B. 0% to 59.5% of optional ingredients selected from the group consisting of perfumes, dyes, manganese stain inhibiting materials, bleach activators, diluent materials and mixtures thereof; and C. 0.5% to 20% of a solubility reducing agent selected from the group consisting of:

$$R-O-\overset{\overset{\displaystyle O}{\|}}{C}-R' \text{ and } R-\overset{\overset{\displaystyle O}{\|}}{C}-O-R'$$

wherein R' is selected from methyl or ethyl and R is selected from:

i. An (m.n.o)bicycloalkane derivative having the following skeletal structure:

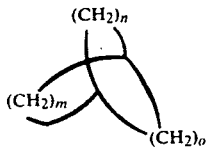

wherein m is from 2 to 3, n is from 1 to 2, and o is from 1 to 2, and wherein a nonbridgehead site of said R moiety is attached to the balance of the molecule;

ii. A derivative of (4.4.0)bicyclo-trans-decalin having the following skeletal structure:

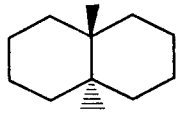

wherein a nonbridgehead site of said R moiety is attached to the balance of the molecule;

iii. A derivative of cyclohexane having the following skeletal structure:

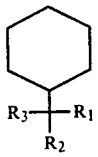

wherein $R_1$, $R_2$ and $R_3$ are each selected from an ethyl, methyl, or propyl moiety, and wherein the balance of the molecule is attached to an unsubstituted position of the cyclohexane ring of said moiety; and iv. An n-nonyl moiety.

19. The dispenser of claim 18 wherein said anionic surfactant is selected from the group consisting of alkali metal paraffin sulfonates, linear alkyl benzene sulfonates having an alkyl chain length of about 11 to 13 carbon atoms, and branched sodium alkyl sulfates having an alkyl chain length of 12 to 15 carbon atoms.

20. The dispenser of claim 19 wherein said anionic surfactant is a sodium paraffin sulfonate surfactant.

21. The dispenser of claim 20 wherein said anionic surfactant comprises about 82% of said composition.

22. The dispenser of claim 18 wherein said solubility reducing agent is selected from the group consisting of isobornyl acetate, myrtenyl acetate, 4-tertiary butyl cyclohexyl acetate, methyl ester of abietic acid, n-nonyl acetate, fenchyl acetate, frutene, isobornyl propionate, cedrenyl acetate, 1-acetoxy-2(1,1-dimethyl-n-propyl)-cyclohexane, and 1-tertiary butyl-4-acetoxy cyclohexane.

23. The dispenser of claim 22 wherein said solubility reducing agent is selected from the group consisting of isobornyl acetate, myrtenyl acetate, 4-tertiary butyl cyclohexyl acetate, methyl ester of abietic acid, and nonyl acetate.

24. The dispenser of claim 23 wherein said solubility reducing agent is isobornyl acetate.

* * * * *